US008512549B1

(12) United States Patent
Ganji

(10) Patent No.: US 8,512,549 B1
(45) Date of Patent: Aug. 20, 2013

(54) PETROLEUM COKING PROCESS AND APPARATUS

(75) Inventor: Kazem Ganji, Norman, OK (US)

(73) Assignee: Kazem Ganji, Norman, OK (US)

( * ) Notice: Subject to any disclaimer, the term of this patent is extended or adjusted under 35 U.S.C. 154(b) by 446 days.

(21) Appl. No.: 12/909,929

(22) Filed: Oct. 22, 2010

(51) Int. Cl.
*C10G 9/14* (2006.01)
*C10G 9/18* (2006.01)

(52) U.S. Cl.
USPC ..... 208/131; 196/107; 196/122; 202/241

(58) Field of Classification Search
USPC ..... 208/131, 48 Q; 196/107, 122, 124; 201/2; 202/241
See application file for complete search history.

(56) References Cited

U.S. PATENT DOCUMENTS

| | | | | | |
|---|---|---|---|---|---|
| 1,657,524 | A | * | 1/1928 | Camp | 196/122 |
| 1,729,307 | A | | 9/1929 | Dubbs | |
| 1,760,400 | A | * | 5/1930 | Cuddy | 196/122 |
| 2,072,524 | A | | 3/1937 | Mace | |
| 2,093,588 | A | | 9/1937 | Forward | |
| 2,132,639 | A | | 10/1938 | Morrell | |
| 2,218,130 | A | * | 10/1940 | Court | 202/241 |
| 2,345,603 | A | * | 4/1944 | Houdry et al. | 196/122 |
| 2,941,928 | A | * | 6/1960 | Sanders et al. | 202/241 |
| 3,194,753 | A | * | 7/1965 | Winter | 208/131 |
| 3,344,057 | A | | 9/1967 | Patrick | |
| 3,917,564 | A | | 11/1975 | Meyers | |
| 3,928,170 | A | | 12/1975 | Takahashi et al. | |
| 4,049,538 | A | | 9/1977 | Hayashi et al. | |
| 4,066,513 | A | | 1/1978 | Jablin | |
| 4,176,052 | A | | 11/1979 | Bruce et al. | |
| 4,257,778 | A | | 3/1981 | Murakami et al. | |
| 4,295,956 | A | | 10/1981 | Metrailer | |
| 4,404,092 | A | | 9/1983 | Audeh et al. | |
| 4,443,328 | A | | 4/1984 | Sakurai et al. | |
| 4,477,334 | A | | 10/1984 | Gomi et al. | |
| 4,487,686 | A | | 12/1984 | Gomi et al. | |
| 4,501,654 | A | | 2/1985 | Allan | |
| 4,521,277 | A | | 6/1985 | Calderon et al. | |
| 4,522,627 | A | | 6/1985 | Gomi et al. | |
| 4,581,124 | A | | 4/1986 | Gomi et al. | |
| 4,612,109 | A | | 9/1986 | Dillon et al. | |
| 4,661,241 | A | | 4/1987 | Dabkowski et al. | |
| 4,666,585 | A | | 5/1987 | Figgins et al. | |
| 4,816,136 | A | | 3/1989 | Allan et al. | |
| 4,839,023 | A | | 6/1989 | Mayer et al. | |
| 4,874,505 | A | | 10/1989 | Bartilucci et al. | |
| 4,919,843 | A | | 4/1990 | Innertsberger et al. | |
| 4,954,240 | A | | 9/1990 | Eidt, Jr. et al. | |

(Continued)

OTHER PUBLICATIONS

"Eureka Cracking", 1976, p. 112 vol. 55, No. 11, Publisher: Hydrocarbon Processing, Published in: US.

(Continued)

*Primary Examiner* — Jill Warden
*Assistant Examiner* — Joye L Woodward
(74) *Attorney, Agent, or Firm* — Dennis D. Brown; Brown Patent Law, P.L.L.C.

(57) ABSTRACT

A process and apparatus for producing solid petroleum coke. The solid petroleum coke product is formed in a coking drum which has a rotatable coke breaking structure installed therein. Quench water or other quench fluid is delivered into the coking drum to quench the coke product and the coke breaking structure is rotated to break up the coke product such that the coke will empty out of the lower end of the coking drum.

26 Claims, 5 Drawing Sheets

(56) References Cited

U.S. PATENT DOCUMENTS

| | | | | |
|---|---|---|---|---|
| 4,961,840 | A | 10/1990 | Goyal | |
| 4,968,407 | A | 11/1990 | McGrath et al. | |
| 4,969,988 | A | 11/1990 | Jain et al. | |
| 4,994,169 | A | 2/1991 | Godino et al. | |
| 5,007,987 | A | 4/1991 | Block et al. | |
| 5,024,730 | A | 6/1991 | Colvert | |
| 5,068,024 | A | 11/1991 | Moretta et al. | |
| 5,169,560 | A | 12/1992 | Hart | |
| 5,296,132 | A | 3/1994 | Hart | |
| 5,389,234 | A | 2/1995 | Bhargava et al. | |
| 5,389,299 | A | 2/1995 | Hart | |
| 5,430,216 | A | 7/1995 | Kerby et al. | |
| 5,439,489 | A | 8/1995 | Scalliet et al. | |
| 5,443,717 | A | 8/1995 | Scalliet et al. | |
| 5,597,474 | A | 1/1997 | Kerby et al. | |
| 5,667,669 | A | 9/1997 | Hart | |
| 5,891,310 | A | 4/1999 | Nelsen | |
| 6,117,308 | A | 9/2000 | Ganji | |
| 6,171,473 | B1 | 1/2001 | Fornoff | |
| 6,764,592 | B1 | 7/2004 | Ganji | |
| 7,303,664 | B2 | 12/2007 | Siskin et al. | |
| 7,438,786 | B2 * | 10/2008 | Malsbury | 201/28 |
| 7,727,382 | B2 | 6/2010 | Sparks et al. | |
| 2003/0098260 | A1 | 5/2003 | Newman et al. | |
| 2005/0123466 | A1 * | 6/2005 | Sullivan | 423/445 R |
| 2007/0108036 | A1 | 5/2007 | Siskin | |
| 2009/0127090 | A1 | 5/2009 | Ganji | |

OTHER PUBLICATIONS

"Flexicoking Conversion Technology", Nov. 28, 2005, Publisher: Internet Article by ExxonMobile Research and Engineering.

"Fluid Coking Conversion Technology", Nov. 28, 2005, Publisher: Internet Article by ExxonMobil Research and Engineering Company, Published in: US.

* cited by examiner

PETROLEUM COKING PROCESS AND APPARATUS

FIELD OF THE INVENTION

The present invention relates to processes and apparatuses for the coking of heavy petroleum materials.

BACKGROUND OF THE INVENTION

Delayed coking systems are commonly used in petroleum refineries for converting vacuum tower bottoms and/or other heavy (i.e., high boiling point) residual petroleum materials to petroleum coke and other products. The greater part of each barrel of resid material processed in the coker will typically be recovered as fuel gas, coker gasoline/naphtha, light cycle oil (also commonly referred to by various other names such as light coker gas oil), and heavy cycle oil (also commonly referred to by various other names such as heavy coker gas oil).

A typical delayed coking system comprises: a combination tower or other fractionator; a fired heater; and at least a pair of vertical coking drums. The heavy coker feed is typically delivered to the bottom of the fractionator where it is combined with a heavy residual bottom product, commonly referred to as "recycle," produced in the fractionator. The resulting mixture is drawn from the bottom of the fractionator and then pumped through the heater and into at least one coking drum. Typically, multiple coking drums are operated in alternating cycles such that, while one drum (referred to herein as the "live" drum) is operating in a "fill cycle," another drum is operating in a second cycle (i.e., a "decoking cycle"). The decoking cycle typically comprises: a steamout to fractionator stage; a steamout to blow down stage; a cooling/quenching stage which further solidifies the coke product within the drum; a draining stage; a drum unheading stage; a hydraulic de-coking stage for cutting the solid coke mass into chunks; a reheading and pressure testing stage; and a warmup/preheating stage.

In the fill cycle, the hot feed material from the coker heater typically flows into the bottom of the live coking drum. Some of the heavy feed material vaporizes in the heater such that the material entering the bottom of the coking drum is a vapor/liquid mixture. The vapor portion of the mixture undergoes mild cracking in the coker heater and experiences further cracking as it passes upwardly through the coking drum. The hot liquid material undergoes intensive thermal cracking and polymerization as it remains in the coking drum such that the liquid material is converted to cracked vapor and petroleum coke.

The resulting combined overhead vapor product produced in the coking drum is typically delivered to the lower portion of the fractionator. The cracked vapor product is typically separated by the fractionator into gas, naphtha, light cycle oil, and heavy cycle oil, which are withdrawn from the fractionator as products, and a heavy recycle/residual material which flows to the bottom of the fractionator. The light and heavy cycle oil products are typically taken from the fractionator as side draw products which are further processed (e.g., in a fluid catalytic cracker) to produce gasoline and other desirable end products. The heavy recycle material combines with the heavy feed material in the bottom of the fractionator and, as mentioned above, is pumped with the heavy feed material through the coker heater.

By way of example, but not by way of limitation, typical coker operating conditions and products specifications include: a coker heater outlet temperature in the range of from about 905° to about 935° F.; live coke drum pressures in the range of from about 20 to about 40 psig; live drum overhead temperatures in the range of from about 800° to about 820° F.; a fractionator overhead pressure in the range of from about 10 to about 30 psig; a fractionator bottom temperature in the range of from about 750° to about 780° F.; a light cycle oil draw temperature in the range of from about 450° to about 550° F.; a light cycle oil initial boiling point (ASTM D-1186) in the range of from about 300° to about 325° F.; a light cycle oil endpoint D-1186 in the range of from about 600° to about 650° F.; a heavy cycle oil draw temperature in the range of from about 600° to 690° F.; a heavy cycle oil initial boiling point (D-1186) in the range of from about 470° F. to about 500° F.; and a heavy cycle oil end point (D-1186) in the range of from about 960° to about 990° F.

There is currently a trend in the U.S. refining industry toward the processing of heavier, lower cost crudes. This results in refiners having to contend with much larger quantities of residual materials in the refining process. This, in turn, increases the demands on the refinery's residual conversion processes, especially delayed coking. Since the greater part of a barrel of residuum (such as, e.g., the high boiling point bottom products from atmospheric or vacuum distillation columns) can be converted to light ends, gasoline, distillate, and gas oil in a coker, the coker has become even more important in today's refinery economics.

Unfortunately, coking systems are often the principal bottleneck in many refineries when it comes to increasing refinery production rates and to improving product quality. The operation of a delayed coking system is a combination batch-continuous process. While one drum is live (i.e., is being filled with hot feed material), another drum is being stripped, quenched, decoked, and warmed.

The time required heretofore for performing drum filling and decoking operations, and particularly for performing decoking operations, in delayed coking systems has severely limited the maximum achievable throughput for these systems. By way of example, in the current delayed coking processes, the coking drums will typically operate on about 18 hour cycles. Thus, while one drum is operating in an 18 hour filling cycle, another drum will undergo an 18 hour decoking cycle.

The cycle length required for most delayed coking systems will typically be determined by the total amount of time necessary to perform all of the various operations which occur during the decoking cycle. A typical 18 hour decoking cycle involves: about 0.5 hours for the steamout to fractionator operation; about 1.0 hours for the steamout to coker blowdown operation; about 5.5 hours for the water quench/fill operation; about 2.0 hours for the quench water draining operation; about 0.5 hours for the drum unheading operation; about 3.0 hours for the decoking (i.e., hydraulic cutting) operation; about 1.0 hours for reheading the coking drum and conducting a pressure test to verify that the drum has not been damaged; and about 4.5 hours for warming the drum with steam to return it to operating temperature.

Many, if not most, of the problems, disadvantages, and shortcomings of the prior art delayed coking process are associated with the hydraulic cutting operation which must be conducted during the decoking cycle in order to break up the solid coke product which has formed in the coking drum. For a coking drum operating on typical 18 hour coking and decoking cycles, a total of about four (4) hours is required for unheading the top of the drum, conducting the hydraulic cutting operation, and then reheading the drum. In addition, the need to unhead the coking drum in order to conduct the hydraulic cutting operation results in a significant amount of volatile organic carbon (VOC) material being released to atmosphere. Further, the tremendous stresses placed on the coking drums during the unheading and reheading operations create a significant potential for drum damage and down time.

Moreover, perhaps the most significant problems and disadvantages associates with the hydraulic cutting operation result from the tremendous amount of wastewater which is produced by the cutting operation and which must be processed in the refinery's wastewater treatment system. In excess of 50%, and commonly as much as 75% or more, of the wastewater volume generated during a drum decoking cycle will be produced by the hydraulic cutting operation. In order to allow this water to be recycled for use in the hydraulic cutting system, it must first be processed in a coke fines removal system in order to adequately remove particulate materials from the water. Such systems take up a great deal of space and are very costly to install and operate. Also, in addition to the coke fines removal system, the hydraulic cutting system requires the use of high pressure pumps, hydraulic drilling and cutting tools, tool hoists, feed water storage vessels, and other equipment and systems which are costly to install and maintain.

Consequently, a need exists for an improved delayed coking process and apparatus which alleviates or eliminates the various problems, limitations, and shortcomings of the delayed coking processes and systems heretofore used in the art.

SUMMARY OF THE INVENTION

The present invention provides an improved coking process and an improved coking apparatus which satisfy the needs and alleviate the problems and shortcomings discussed above. The inventive process and apparatus can be used for constructing and operating new coking systems or for improving existing coking systems.

In one aspect, there is provided a process for producing a petroleum coke product from a drum feed material. The process comprises the steps of: (a) delivering the feed material into a coking drum to form the petroleum coke product in the coking drum, the coking drum having a rotatable coke breaking structure therein; (b) delivering a quench fluid (i.e., water or other quench fluid) into the coking drum to quench the petroleum coke product; and (c) rotating the rotatable coke breaking structure in the coking drum to break up the petroleum coke product such that the petroleum coke product will empty out of a lower end of the coking drum.

In another aspect, there is provided an apparatus for producing a petroleum coke product. The apparatus comprises: (a) a coking drum for receiving a drum feed material to produce the petroleum coke product; (b) a rotatable coke breaking structure which is installed in the coking drum in a manner such that the rotatable coke breaking structure will remain in the coking drum during repeated fill and decoking cycles for the coking drum, the rotatable coke breaking structure including a drive shaft having an upper end portion which extends out of an upper end of the coking drum; and (c) a motor which is operably linked to the upper end portion of the drive shaft for rotating the rotatable coke breaking structure within the coking drum.

In contrast to the prior art delayed coking process described above, the inventive process and apparatus entirely eliminate the unheading, hydraulic decoking, and reheading procedures previously performed during the decoking cycle. Consequently, the inventive process and apparatus will, for example, allow each of the previous 18 hour cycles typically required for drum filling and decoking to be reduced to just 14 hours. This 22% reduction in the required cycle time for the coking system amounts to more than a 28% increase in the effective operating capacity of the coking system.

By eliminating the need to perform unheading, hydraulic cutting, and reheading procedures during the decoking cycle, the present invention: (a) reduces the amount of wastewater produced in the coking operation by an amount of from about 50% to about 75% or more; (b) eliminates the need to install, operate, and maintain hydraulic decoking systems for the coking drums; (c) eliminates the need to purchase, install, operate, and maintain a coke fines removals system for wastewater treatment; (d) eliminates the potential for damage to the coking drums which heretofore existed because of the need to perform repeated unheading and reheading operations; and (e) prevents the release of VOCs to the atmosphere which previously occurred as a result of the drum unheading procedure.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
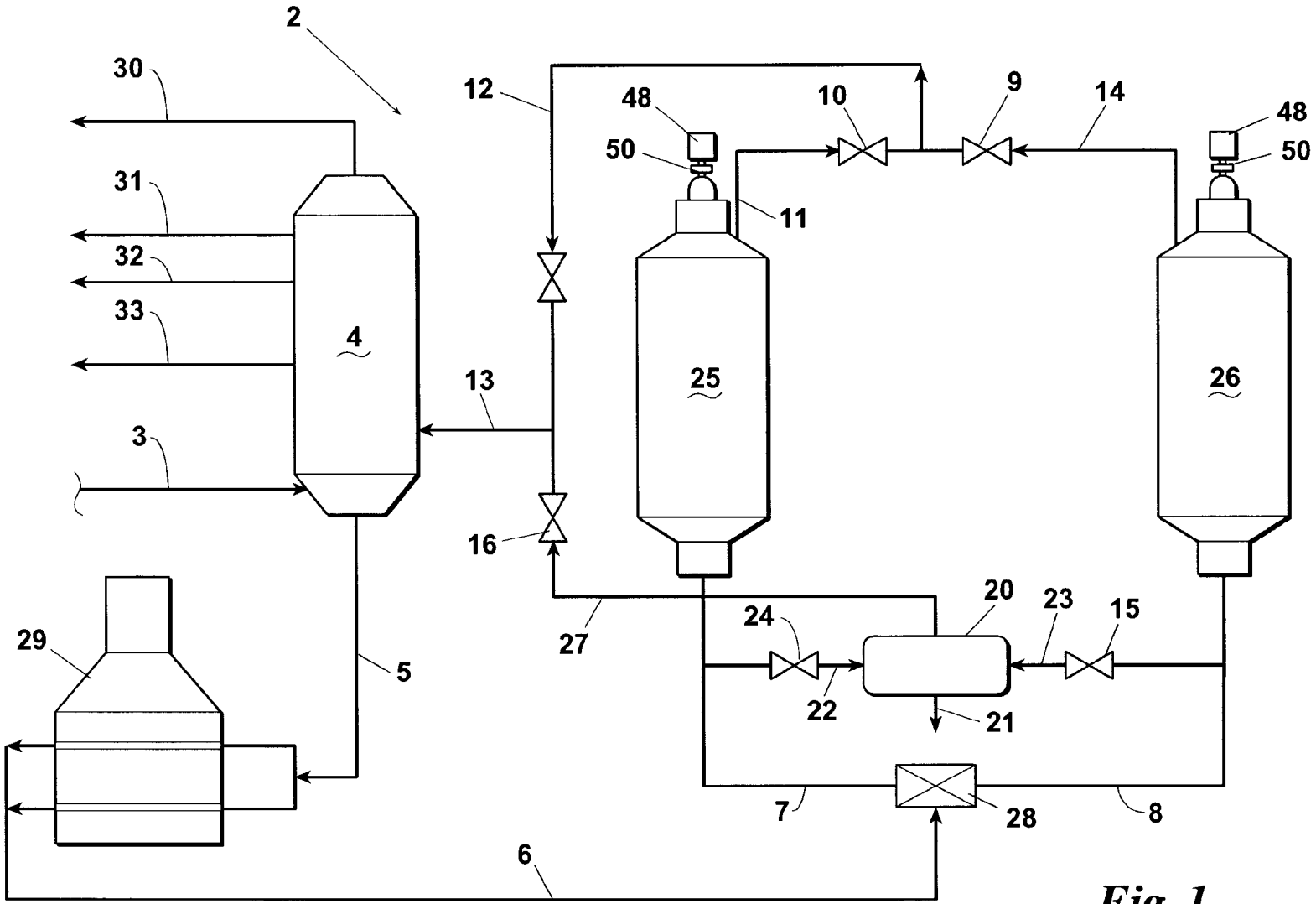
FIG. 1, schematically illustrates an embodiment 2 of an improved delayed coking system provided by the present invention.

FIG. 1 schematically illustrates an embodiment 2 of an improved delayed coking system provided by the present invention. Crude vacuum resid, atmospheric resid, heavy crude oil, and/or any other coker petroleum feed material flows through conduit 3 to the bottom portion of a coker fractionator 4. In the bottom of fractionator 4, heavy fractionator bottoms liquid (recycle) combines with the coker feed. The combined heavy liquid material is pumped via conduit 5 through coker heater 29. The hot material then flows through conduit 6 to a switch valve 28.

The improved coking system 2 depicted in FIG. 1 preferably includes at least two inventive vertical coking drum assemblies 25 and 26. The coking drum assemblies 25 and 26 are operated in alternating cycles such that, when one drum (i.e., the live drum) is operating in the fill cycle, the other drum is operating in the decoking cycle. If drum assembly 25 is operating in the fill cycle, valve 24 is closed and switch valve 28 diverts the hot feed material to the bottom of drum assembly 25 via conduit 7. However, if drum assembly 26 is operating in the fill cycle, valve 15 is closed and switch valve 28 diverts the hot feed material to the bottom of drum assembly 26 via conduit 8. Assuming, for illustration purposes, that drum assembly 25 is operating in the fill cycle, drum 26 overhead valve 9 will be closed (except possibly when performing a warming procedure just prior to switching to a fill cycle) and the overhead valve 10 for drum assembly 25 will be open such that the vapor produced in live drum 25 will flow to fractionator 4 via lines 11, 12, and 13.

Although two coking drum assemblies 25 and 26 are shown in FIG. 1, it will be understood that the inventive delayed coking system 2 could alternatively utilize more than two coking drum assemblies or only a single coking drum assembly. It will also be understood that it is not essential for the coker feed material to be delivered to the fractionator 4 but could instead, for example, be delivered (a) directly to the coker heater, (b) to a pre-flash tower, or (c) to some other precoking apparatus or system.

The inventive delayed coking system 2 will also preferably include drum steamout lines, quench water fill lines, one or more quench water pumps (preferably a trash pump), and quench drain lines which are commonly provided in delayed coking systems and are not shown in the drawings.

The coking fractionator 4 will preferably include typical pump around and condensing systems (not shown) for fractionating the vapor product. Typical products provided by the fractionator will include: an overhead cracked gas (e.g., fuel gas) product 30; an overhead gasoline/naphtha distillate product 31; a light cycle oil side draw product 32; and a heavy gas oil side draw product 33. As indicated above, various names are used in the art to identify the light and heavy cycle oil products. The names "light cycle oil" and "heavy cycle oil" used herein and in the claims refer to and encompass all such products.

When drum 26 reaches the warm-up stage at the end of the decoking cycle, overhead valve 9 can be opened such that a portion of the vapor product produced in the live drum 25 flows into the top of drum 26 via line 14. Valves 15 and 16 are also open such that the warm-up vapor flows downwardly through drum 26 and then into condensate drum 20 via line 23. Condensate produced in the warm-up process collects in the condensate drum 20 and is removed via conduit 21. The non-condensed warm-up material flows from condensate drum 20 to vapor product line 13 via line 27. The noncondensed warm-up material then flows with the remaining overhead product vapor into fractionator 4.

As will be understood by those in the art, the operating conditions (i.e., temperatures, pressures, etc.) employed in the coking system 2 can vary substantially depending upon: the specific coker feed used; desire product specifications; desired product make; unit designs; etc. Generally, typical operation conditions such as those described above for prior coking systems, or any other desired conditions and parameters, can be used when employing the present invention.

Figure 2:
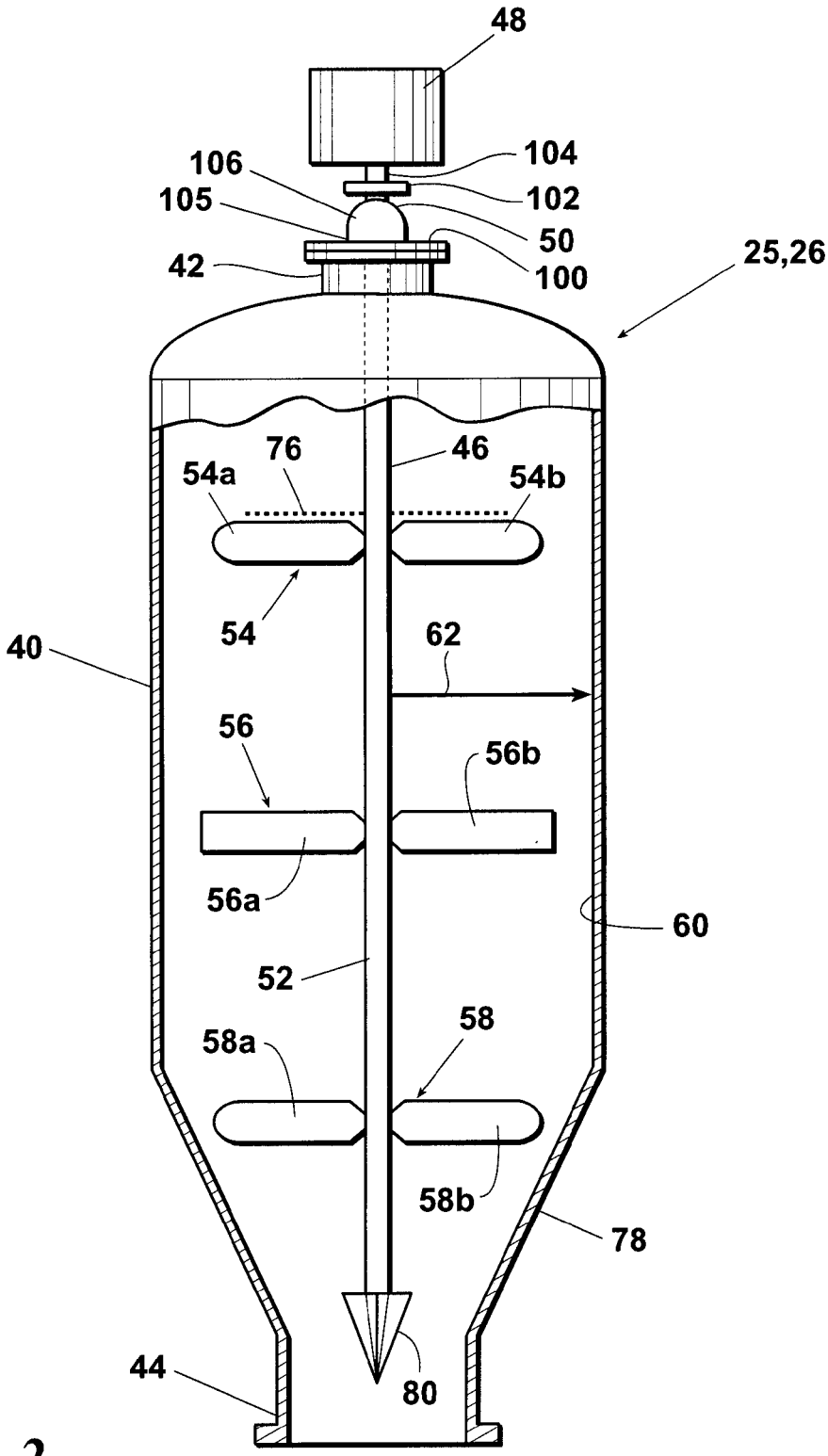
FIG. 2 provides a cutaway elevational view of an inventive coking drum assembly 25 or 26 which is used in the improved delayed coking system 2.

An embodiment of the inventive coking drum assembly 25, 26 employed in the improved delayed coking system 2 is illustrated in FIG. 2. The inventive coking drum assembly 25, 26 preferably comprises: a vertical coking drum 40 having a top opening 42 and a larger bottom opening 44; a rotatable coke breaking structure 46 which is "permanently" installed in the coking drum 40; and an exterior drive motor 48 which is operably linked, either directly or indirectly, to the upper end portion 50 of the drive shaft 52 of the rotatable coke breaking structure 46. As used herein and in the claims, references to the coke breaking structure being "permanently" installed in the vertical coking drum 40 mean that the breaking structure 46 is installed in the drum 40 in a manner such that the breaking structure 46 will remain in (i.e., will not be removed from) the coking drum 40 during the course of repeated fill and decoking cycles. References to the rotatable coke breaking structure 46 being permanently installed do not mean that the rotatable coke breaking structure cannot be removed from the coking drum 40 for repair, replacement, or other reasons.

In order to withstand the extreme temperatures, temperature swings and other conditions experienced in the coking drum 40 during alternating fill and decoking cycles, the rotatable coke breaking structure 46 will preferably be formed of heavy stainless steel or other material capable of withstanding and operating in such conditions.

The rotatable coke breaking structure 46 can be any type of assembly or other structure which is capable of withstanding the conditions in the coking drum 40 during alternating fill and decoking cycles and which will operate to sufficiently break up the petroleum coke product produced in the coking drum 40 such that the resulting chunks or pieces of the solid petroleum coke product will empty out of the lower end 44 of the drum 40.

The rotatable coke breaking structure 46 preferably comprises at least one set, more preferably a plurality of sets 54, 56, and 58, of impacting structures which extend outwardly from the vertical drive shaft 52 toward the interior wall 60 of the coking drum 40. Each individual impacting structure 54*a*, 54*b*, 56*a*, 56*b*, 58*a*, and 58*b* preferably extends radially from the drive shaft 52 toward the interior wall 60 of the coking drum 40. In addition, each individual impacting structure 54*a*, 54*b*, 56*a*, 56*b*, 58*a*, and 58*b* preferably extends radially in the coking drum 40 to a distance which is at least 40%, more preferably at least 50%, more preferably at least 55%, more preferably at least 60%, more preferably at least 65%, more preferably at least 70%, and most preferably at least 75% of the interior radius 62 of the cylindrical portion 64 of the vertical coking drum 40.

The rotatable coke breaking structure 46 preferably comprises at least one, more preferably at least two, sets of impacting structures 54 and 58 which comprise one or more, preferably two, radially extending impeller elements 54*a*, 54*b*, 58*a* and 58*b*. As the impeller elements 54*a*, 54*b*, 58*a* and 58*b* rotate within the vertical coking drum 40, they assist in breaking up the coke material within the drum 40. In addition, similar to the impeller blades of a centrifugal pump, the impeller elements 54*a*, 54*b*, 58*a* and 58*b* preferably operate to discharge the coke pieces outwardly toward the interior wall 60 of the drum 40, thus causing beneficial circulation of the coke material within the drum 40 which further facilitates and enhances the crushing process.

As with the impeller elements of a centrifugal pump, the impeller elements 54*a*, 54*b*, 58*a* and 58*b* can have flat contacting surfaces which face forwardly in the direction of rotation or can have curved forward contacting surfaces such that the outer end of the of the impeller element 54*a*, 54*b*, 58*a* or 58*b* curves forwardly or rearwardly, preferably forwardly, in the direction of rotation of the rotatable coke breaking structure 46.

Figure 3:
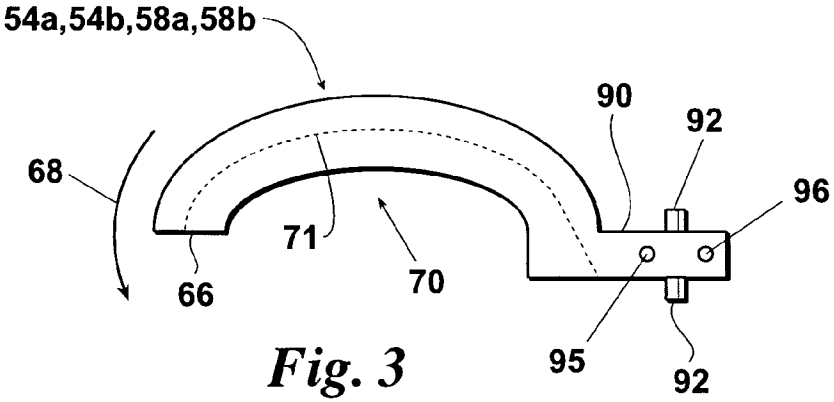
FIG. 3 is a top plan view of an embodiment 54*a*, 54*b*, 58*a*, or 58*b* of an impeller element used in the inventive coking drum assembly 25, 26.

A preferred impeller element 54*a*, 54*b*, 58*a*, 58*b* used in the rotatable breaking structure 46 is depicted in FIG. 3. The preferred impeller element depicted in FIG. 3 is a curved element having an outer end 66 which curves forwardly in the direction of rotation 68 of the rotatable breaking structure 46. In addition, the forward face 70 of the impeller structure depicted in FIG. 3 is preferably recessed, as illustrated at 71, along at least most of the length of the forward face 70 such that the impeller element also scoops the solid coke product as the impeller element rotates within the coking drum 40.

Figure 4:
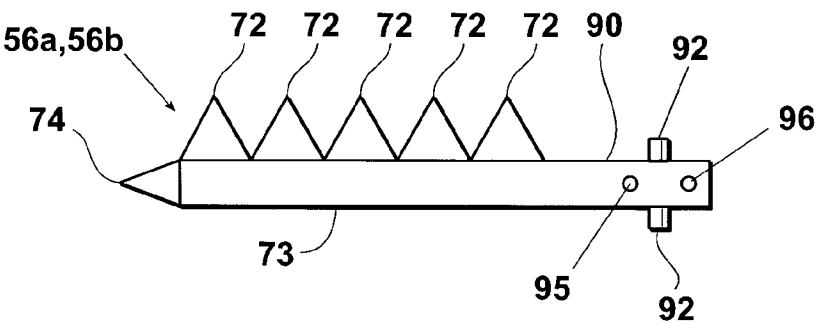
FIG. 4 is a top plan view of an embodiment 56*a*, 56*b* of a breaking structure used in the inventive coking drum assembly 25, 26.

The rotatable coke breaking structure 46 also preferably comprises at least one set of impacting structures 56 which comprises one or more, preferably two, radially extending breaking elements 56*a* and 56*b*. As illustrated in FIG. 4, the radially extending breaking elements 56*a*, 56*b* preferably comprise: a radially extending bar 73; a plurality of cutting teeth 72 which project from the forward face of the radial bar 70 in the direction of rotation; and an additional cutting tooth 74 projecting from the outer end of the bar 73.

As illustrated in FIG. 2, the sets of impacting structures 54, 56, and 58 are preferably spaced vertically apart on the drive shaft 52. The upper set 54 is preferably positioned such that it will be located below, more preferably not more than ten feet below and most preferably not more than five feet below, the coke fill level 76 of the vertical drum 40. Most preferably, the rotatable coke breaking structure 46 comprises at least two sets 54 and 58 of impeller elements and one set 56 or more of breaking elements, the set(s) of breaking elements 56 being spaced vertically apart from and in alternating relationship with the sets of impeller elements 54 and 56.

Most preferably, the rotatable coke breaking structure 46 comprises: an upper set of impeller elements 54 positioned just below the coke fill level 76 of the drum 40; a set of breaking elements 56 spaced below the set of the impeller elements 54 in the vertical mid-portion (i.e., the middle one-third) of the coking drum 40; and a second set of impeller elements 58 spaced vertically below the set of breaking elements 56. The lower set of impeller elements 58 is preferably vertically positioned at or just below the transition from the cylindrical portion 64 to the lower frusto-conical portion 78 of the vertical drum 40.

Figure 6:
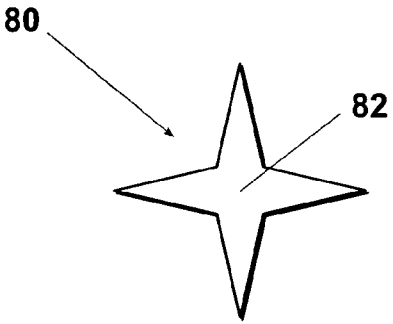
FIG. 6 is a top plan view of the cutting tip 80.
Figure 5:
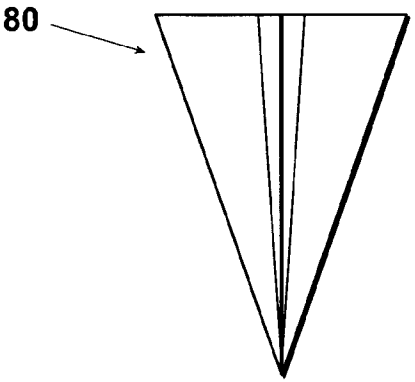
FIG. 5 is an elevational view of an embodiment 80 of a cutting tip used in the inventive coking drum assembly 25, 26.

The rotatable coke breaking structure 46 also preferably comprises a cutting tip 80 at the lower end of the drive shaft 52. Although other shapes can alternatively be employed, the cutting tip 80 will preferably have a downwardly pointing V-shaped vertical profile as illustrated in FIGS. 2 and 5 and a star-shaped cross section 82 as illustrated in FIG. 6. The cross section 82 of the cutting tip illustrated in FIG. 6 is a four-pointed star. It will be understood, however, that a star-shaped cross section having three, five, or more points could alternatively be employed. For use in a vertical coking drum 40 of typical size, the upper end of the cutting tip 80 will preferably have a width of from about one to three feet and will more preferably have a width of about two feet.

The rotatable coke breaking structure 46 preferably extends downwardly in the coking drum to a vertical depth which is at least 60% of the entire vertical depth of the coking drum 40. More preferably, the rotatable coke breaking structure 46 extends to a depth which is at least 70%, more preferably at least 75%, more preferably at least 80%, and most preferably at least 85% of the entire vertical depth of the vertical coking drum 40.

As will be understood by those in the art, various techniques can be used for installing the rotatable coke breaking structure 46 within the interior of the vertical coking drum 40. By way of example, a typical vertical coking drum 40 will have a total vertical height of about 125 feet, an upper flange opening 42 which is about three feet in diameter, and a lower flange opening 44 which is about five feet in diameter. Consequently, using a hoist cable which extends downwardly through the upper opening 42 and on through the lower opening 44, the drive shaft 52, impeller elements 54*a*, 54*b*, 58*a* and 58*b*, and the breaking elements 56*a* and 56*b* can be lifted upwardly through the bottom opening 44 of the drum and assembled, by welding and/or by mechanical means such as bolting, by workmen positioned inside the drum 40. If desired or necessary, the drive shaft 52 and/or other components of the rotatable coke breaking structure 46 can be further broken down into connectable pieces or segments which can be connected together within the interior of the drum 40.

Figure 8:
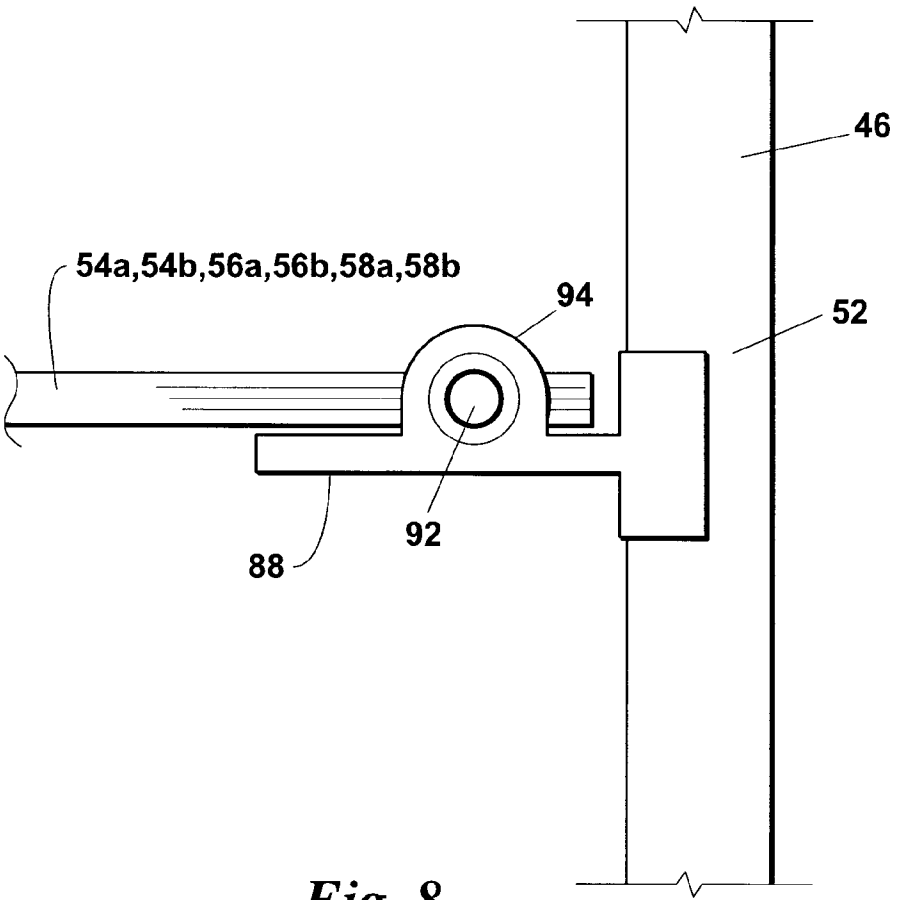
FIG. 8 schematically illustrates the pre-assembled impacting structure 54*a*, 54*b*, 56*a*, 56*b*, 58*a*, or 58*b* deployed in a horizontal operating position.
Figure 7:
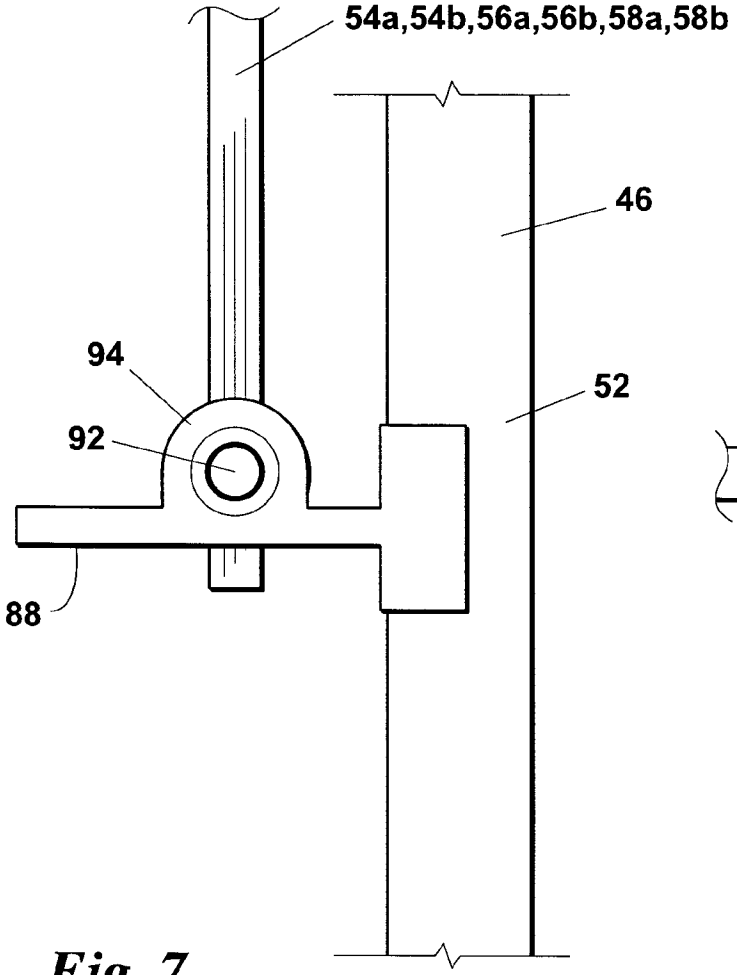
FIG. 7 schematically illustrates a pre-assembled impacting structure assembly with the impacting structure 54*a*, 54*b*, 56*a*, 56*b*, 58*a*, or 58*b* in an upwardly folded vertical position.
Figure 10:
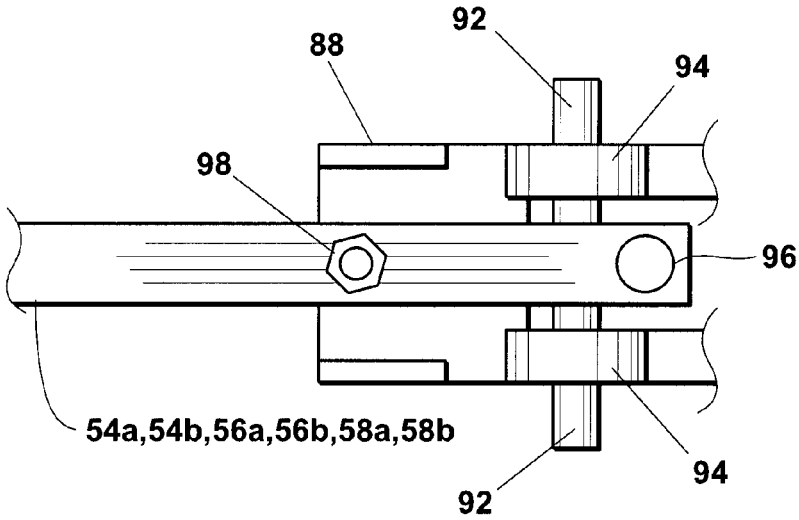
FIG. 10 is a top plan view of the deployed impacting structure 54*a*, 54*b*, 56*a*, 56*b*, 58*a*, or 58*b* as seen from perspective 10-10 shown in FIG. 9.
Figure 9:
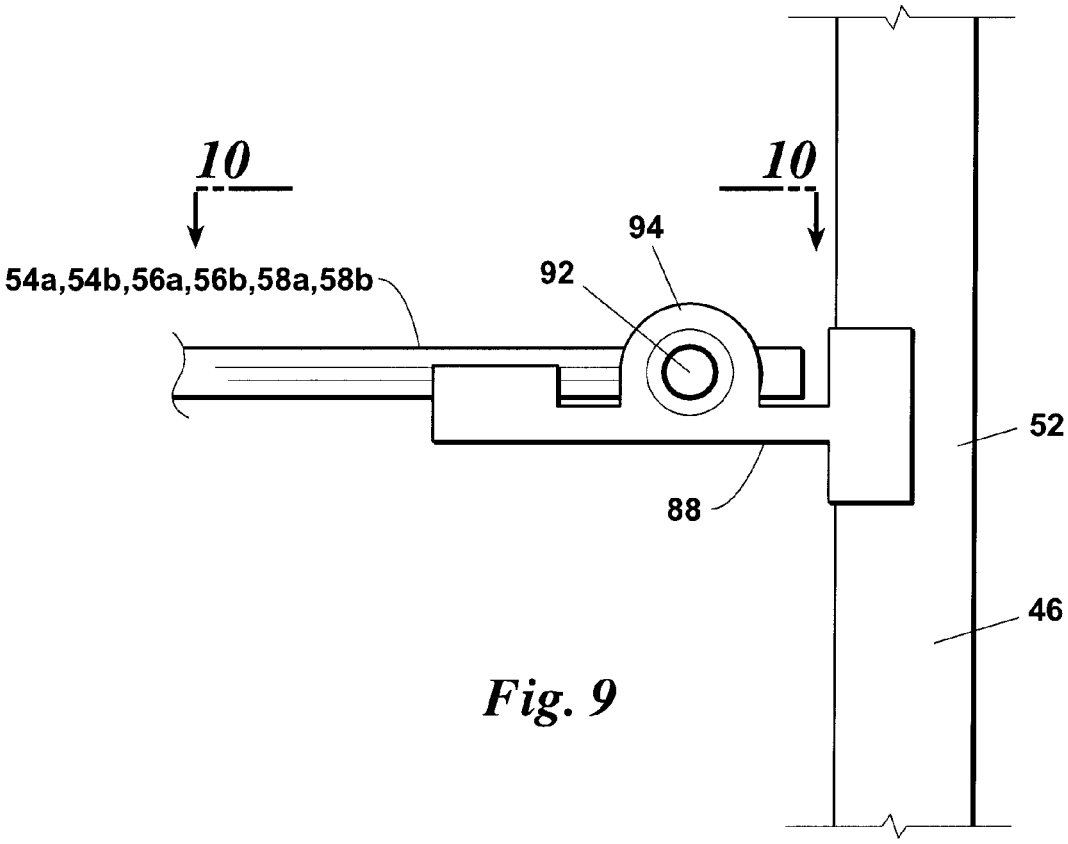
FIG. 9 also schematically illustrates the pre-assembled impacting structure 54*a*, 54*b*, 56*a*, 56*b*, 58*a*, or 58*b* deployed in a horizontal operating position.

In an example of yet another alternative, as schematically illustrated in FIGS. 7-10, the entire rotatable coke breaking structure 46 can be preassembled and lowered through the upper flange opening 42 of the coking drum 40 by the use of foldable (preferably upwardly foldable) impacting elements 54*a*, 54*b*, 56*a*, 56*b*, 58*a* and 58*b*. By way of example, the foldable version of each impacting structure may comprise: a short base structure 88 which is attached to and extends radially outward from the drive shaft 52; a base end portion 90 of the impacting structure 54*a*, 54*b*, 56*a*, 56*b*, 58*a* and 58*b* which has laterally extending pivot arms 92 which are rotatably received in rotational brackets 94 extending upwardly from the base structure 88; a pull hole 96 provided through the base end portion 90 of the impacting structure for running a cable or rope through the pull hole 96 for pivoting the impacting structure downwardly from its vertical position as illustrated in FIG. 7 to a horizontal, radially extending, deployed position as illustrated in FIG. 8; and one or more sets of aligned apertures 95 provided through the base end portion 90 of the impacting structure and through the base structure 88 for bolting the base end portion 90 of the impacting structure in deployed horizontal position on the base structure 88 using one or more bolts 98.

By way of further example, other alternative embodiments of the foldable impacting structures could utilize (a) latch clip assemblies which operate to automatically lock the impacting structure in horizontal deployed position when it is unfolded and which can also preferably be unlocked from outside of the drum and (b) systems employing hydraulic or pneumatic pistons for folding and deploying the impacting structures.

Generally any type of direct or indirect (e.g., chain drive) drive system 48 can be used for rotating the rotatable coke breaking structure 46. The drive system will preferably comprise a drive motor 48 and will preferably be operable at variable speeds so that the rotational speed of the coke breaking structure 46 can be changed during the coke breaking operation. Because of (a) the need for a high degree of temperature resistance, (b) the range of speeds preferred, and (c) the amount of torque required during the coke breaking operation, the drive motor 48 will preferably be an electric or hydraulic motor and will most preferably be a hydraulic motor.

At the beginning of the coke breaking operation, the coke breaking structure 46 might be operated at a rotational speed as low as 60 rpm and will most preferably be operated at a beginning (low) rotational speed in the range of from about 250 to about 500 rpm. During the course of the coke breaking operation, the rotational speed of the rotatable coke breaking structure 46 will preferably be increased such that the ultimate (high) rotational speed of the coke breaking structure 46 may be as much as 4500 rpm and will preferably be in the range of from about 2400 to about 4000 rpm.

The upper end portion 50 of the drive shaft 52 rotatably extends through a drum top flange lid 100 and is preferably connected at 102 to the drive shaft 104 of the drive motor 48 by bolting and/or welding. The drum top flange lid 100 is bolted to the upper flange opening 42 of the drum 40 to thereby close the upper end of the drum. As will further be understood by those in the art, the upper end portion 50 of the drive shaft 52 also preferably extends through a shaft bearing (preferably a roller bearing) 105 installed against the outer face of the flange lid 100 and through a mechanical seal package 106 (preferably a spring-loaded mechanical seal as used for hydraulic pumps and other equipment) which provides a heat resistant pressure seal for the passage of the drive shaft 52 through the drum lid 100.

By eliminating the unheading, hydraulic coke cutting, and reheading procedures required in prior delayed coking systems, the present invention reduces fill and decoking cycle times by more than 20% and, consequently, will increase the effective capacity of the refinery delayed coking system by more than 25%. By way of example, the following table compares the cycle and procedure times for a current delayed coking system operating on 18 hour cycles to the same system when operating on 14 hour cycles in accordance with the present invention upon installation of the inventive rotatable coke breaking structure 46.

TABLE

| COKING CYCLE OPERATION | PRIOR ART PROCEDURE AND SYSTEM (HOURS) | INVENTIVE OPERATION AND SYSTEM (HOURS) |
|---|---|---|
| COKING | 18.0 | 14.0 |
| STEAMOUT TO FRACTIONATOR | 0.5 | 0.5 |
| STEAMOUT TO BLOWDOWN | 1.0 | 1.0 |
| QUENCH/FILL | 5.5 | 5.5 |
| DRAINING | 2.0 | 2.0 |
| UNHEADING | 0.5 | — |
| HYDRAULIC DECOKING | 3.0 | — |
| REHEADING AND TESTING | 1.0 | 0.5 |
| PREHEATING | 4.5 | 4.5 |
| TOTAL | 36.0 | 28.0 |

In the inventive process, the coke breaking operation is preferably conducted by rotating the coke breaking structure 46 in conjunction with the performance of the quench/fill operation during the drum decoking cycle. For approximately the first 30 minutes of the quench/fill operation, much of the quench water will convert to steam and the remainder will begin to accumulate in the bottom of the coking drum 40. It is preferred that the rotation of the coke breaking structure 46 be initiated, preferably at low rotational speed, while the coke product is relatively soft, preferably before or during the first 45 minutes of the quench/fill operation and most preferably at or near the end of the first 30 minutes of the quench/fill operation.

The rotation of the breaking structure 46 will most preferably begin at a relatively slow speed of not more than 600 rpm, more preferably a speed in the range of from about 250 to about 500 rpm. As the quench/fill operation continues, the rotational speed of the coke breaking structure 46 will preferably be increased either continuously or incrementally to an ultimate speed of at least 2000 rpm, most preferably from about 2450 to about 3600 rpm. The rotational speed of the coke breaking structure 46 will preferably be incrementally increased approximately every 30 minutes such that the maximum speed of the coke breaking structure 46 is reached after a total quench/fill time in the range of from about 1.5 to about 2 hours. Most preferably, a three stage procedure is used wherein the rotation of the breaking structure begins at a low speed of from about 250 to about 500 rpm and is then incrementally increased to a medium speed of from about 1050 to about 1760 rpm and then to a high speed of from about 2450 to about 3600 rpm.

The inventive coke breaking structure 46 and process is effective for breaking the solid coke product within the drum 40 into pieces having a size of not more than four inches and more preferably in the range of from about $1/16^{th}$ to about two inches. Consequently, when the quench/fill process is completed and the quench water injection pump is shut off, the crushed coke product will drain from the bottom of the coking drum 40 along with the quench water. The rotation of the coke breaking structure 46 will preferably be continued either at full speed or medium speed throughout all or most of the quench draining process. Alternatively, the rotation of the coke breaking structure can be reduced to low speed during the entire quench draining process or more preferably after at least the first 30 minutes of the draining process.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed:

1. A process for producing a petroleum coke product from a drum feed material comprising the steps of:

(a) delivering said drum feed material into a coking drum, said coking drum having a rotatable coke breaking structure therein which extends downwardly in said coking drum and includes at least one coke impacting structure which extends outwardly toward an upwardly extending interior wall of said coking drum, wherein said drum feed material comprises a liquid which fills said coking drum in step (a) to a level above said coke impacting structure, but below an upper end of said coking drum, and wherein said liquid forms into a solid petroleum coke product mass which fills said coking drum to a level above said coke impacting structure such that said coke impacting structure is positioned within said solid petroleum coke product mass;

(b) delivering a quenching fluid into said coking drum to quench said solid petroleum coke product mass; and (c) rotating said coke impacting structure of said rotatable coke breaking structure in said coking drum within said solid petroleum coke product mass to break up said solid petroleum coke product mass to form a broken petroleum coke product which will empty out of a lower end of said coking drum.

2. The process of claim 1 wherein said rotatable coke breaking structure further includes a drive shaft which extends through said upper end of said coking drum.

3. The process of claim 2 wherein said drive shaft is powered by an exterior drive motor which is operated in step (c) to rotate said rotatable coke breaking structure within said coking drum.

4. The process of claim 3 wherein said exterior drive motor is a hydraulic motor.

5. The process of claim 2 wherein:

said rotatable coke breaking structure comprises a plurality of said coke impacting structures which extend outwardly from said drive shaft within said coking drum toward said upwardly extending interior wall of said coking drum, said coke impacting structures are each below said level of said solid petroleum coke product mass when said solid petroleum coke product mass is formed from said liquid in step (a) such that said coke impacting structures are positioned within said solid petroleum coke product mass, said coke impacting structures do not extend all of the way to said upwardly extending interior wall of said coking drum, and said coke impacting structures are rotated within said solid petroleum coke product mass in step (c) to break up said solid petroleum coke product mass.

6. The process of claim 5 wherein said coke impacting structures remain in fixed vertical position within said coking drum throughout steps (a), (b), and (c).

7. The process of claim 5 wherein said coke impacting structures comprise at least two radially extending impeller elements.

8. The process of claim 5 wherein said coke impacting structures comprise a set of at least two radially extending breaking elements having forwardly projecting cutting teeth.

9. The process of claim 8 wherein said coke impacting structures further comprise a set of at least two radially extending impeller elements which is spaced vertically apart from said set of at least two radially extending breaking elements.

10. The process of claim 5 wherein said rotatable coke breaking structure further comprises a cutting tip provided on a lower end of said drive shaft within said coking drum.

11. The process of claim 10 wherein said cutting tip has a V-shaped vertical profile and a star-shaped cross section.

12. The process of claim 5 wherein each of said coke impacting structures extends radially outward from said drive shaft to a distance which is at least 50% of an internal radius of said coking drum.

13. The process of claim 1 further comprising the step of simultaneously emptying said broken petroleum coke product and said quenching fluid from said coking drum.

14. The process of claim 1 wherein said rotatable coke breaking structure is rotated in said coking drum in step (c) while at least a portion of said quenching fluid is being delivered into said coking drum in step (b).

15. The process of claim 1 wherein said rotatable coke breaking structure extends downwardly in said coking drum to a vertical depth which is at least 60% of an entire vertical depth of said coking drum.

16. The process of claim 1 wherein:

during an initial portion of step (c), said rotatable coke breaking structure is rotated in said coking drum at a speed of not more than 600 rpm and after said initial portion of step (c), said rotatable coke breaking structure is rotated in said coking drum in a later portion of step (c) at a speed of at least 2000 rpm.

17. An apparatus for producing a petroleum coke product comprising:

A delayed coking drum having a bottom inlet for a drum feed material comprising a liquid which will form into a solid petroleum coke product mass in said delayed coking drum, said delayed coking drum having a liquid fill level below an upper end of said delayed coking drum to which said delayed coking drum will be filled with said liquid;

a rotatable coke breaking structure which is installed in said delayed coking drum in a manner such that said rotatable coke breaking structure will remain in said delayed coking drum during repeated fill and decoking cycles for said delayed coking drum, said rotatable coke breaking structure including a drive shaft having an upper end portion which extends out of said upper end of said delayed coking drum and said rotatable coke breaking structure further comprising a plurality of coke impacting structures which extend outwardly from said drive shaft toward an upwardly extending interior wall of said delayed coking drum; and a motor which is operably linked to said upper end portion of said drive shaft for rotating said rotatable coke breaking structure within said delayed coking drum, wherein said coke impacting structures of said rotatable coke breaking structure are installed in fixed vertical position in said delayed coking drum below said liquid fill level and said coke impacting structures do not extend all of the way to, and do no contact, said upwardly extending interior wall of said delayed coking drum.

18. The apparatus of claim 17 wherein said motor is a hydraulic motor.

19. The apparatus of claim 17 wherein said coke impacting structures comprise at least two radially extending impeller elements.

20. The apparatus of claim 17 wherein said coke impacting structures comprise a set of at least two radially extending breaking elements having forwardly projecting cutting teeth.

21. The apparatus of claim 20 wherein said coke impacting structures further comprise a set of at least two radially extending impeller elements which is spaced vertically apart from said set of at least two radially extending breaking elements.

22. The apparatus of claim 17 wherein said rotatable coke breaking structure further comprises a cutting tip provided on a lower end of said drive shaft within said delayed coking drum.

23. The apparatus of claim 22 wherein said cutting tip has a V-shaped vertical profile and a star-shaped cross section.

24. The apparatus of claim 17 wherein each of said coke impacting structures extends radially outward from said drive shaft to a distance which is at least 50% of an internal radius of said delayed coking drum.

25. The apparatus of claim 17 wherein said rotatable coke breaking structure extends downwardly in said delayed coking drum to a vertical depth which is at least 60% of an entire vertical depth of said delayed coking drum.

26. The apparatus of claim 17 wherein:

said apparatus further comprises a flange lid which closes said upper end of said delayed coking drum and said upper end portion of said drive shaft rotatably extends through said flange lid and through a flange bearing and a mechanical seal which are positioned outside of said flange lid.

* * * * *